United States Patent [19]

Patterson

[11] 4,221,088

[45] Sep. 9, 1980

[54] LOW LIFT, ELEVATABLE HIGH FLOOR DRILLING MAST AND SUBSTRUCTURE ARRANGEMENT THEREFOR

[75] Inventor: Bradley C. Patterson, Spring, Tex.

[73] Assignee: PRE Corporation Mfg. Co., Houston, Tex.

[21] Appl. No.: 441

[22] Filed: Jan. 2, 1979

[51] Int. Cl.[2] ..... E04N 12/34

[52] U.S. Cl. ..... 52/116; 52/120

[58] Field of Search ..... 52/116, 118, 120

[56] References Cited

U.S. PATENT DOCUMENTS

| | | | |
|---|---|---|---|
| 3,262,237 | 7/1966 | Jenkins et al. | 52/120 X |
| 3,483,933 | 12/1969 | Dyer et al. | 52/116 X |
| 3,747,695 | 7/1973 | Branham | 52/116 X |
| 3,749,183 | 7/1973 | Branham et al. | 52/116 X |
| 3,803,780 | 4/1974 | Donnally | 52/120X |
| 3,807,109 | 4/1974 | Jenkins et al. | 52/120 |
| 4,024,924 | 5/1977 | Houck | 52/116X |
| 4,138,805 | 2/1979 | Patterson | 52/116 X |

*Primary Examiner*—James A. Leppink
*Assistant Examiner*—Carl D. Friedman
*Attorney, Agent, or Firm*—Jack W. Hayden

[57] ABSTRACT

Low level base means extend longitudinally on the earth's surface. Drilling mast support means are positioned adjacent and pivotally connected to the base means and setback tower means are pivotally connected to the mast support means and to the base means. Drilling mast means are secured to the mast support means. Lifting frame means are connected to the drilling mast support means whereby said drilling mast support means, mast connected thereto and setback tower means may be simultaneously elevated from a reclined position to an upright position on the base means. Cable means may be secured at one end to the lifting frame means and extended around sheave means on the base means over sheave means on the lifting frame means and under sheave means on the mast support means and then connected at its other end with any suitable power source to exert a pull on the cable and elevate the mast support, mast and setback tower to an upright position on the base means where the mast may be secured in upright position. Elevatable drawworks support means is pivotally connected to the low level base means adjacent the other side of the drilling mast support means. The drawworks support means is provided with rotary table support means projecting from the drawworks support means. When the elevatable drawworks support means is raised to position it adjacent the upright drilling mast support means in a manner well known, the rotary table support means is properly positioned adjacent the drilling mast setback tower means so that the rotary table support means may be secured to the elevated setback tower to form a rigid substructure for the upright drilling mast.

13 Claims, 5 Drawing Figures

LOW LIFT, ELEVATABLE HIGH FLOOR DRILLING MAST AND SUBSTRUCTURE ARRANGEMENT THEREFOR

SUMMARY OF THE INVENTION

Various types of high floor, elevatable drilling mast, setback tower means, and drawwork means have been provided in the prior art. Generally speaking, such prior art structures are such that the drilling mast must be pivotally connected adjacent the upper end of an upwardly extending support structure which structure is supported at its lower end on the earth's surface. In rigging up the mast, this high support structure requires that the drilling mast be first elevated a substantial extent above the earth's surface for pivotally connecting the lower end of the drilling mast adjacent the upper end of the support structure before the mast can be elevated to an upright position. Also, such prior art arrangements require use of an A frame or crane for subsequent elevation of the drilling mast to an upright position. In some instances the A frame serves as support for such elevated drilling mast to maintain it in an upright position and the A frame may hinder or interfere with the proper positioning of the elevatable drawworks, and may restrict the amount of working area available.

Such prior art drilling mast means, setback tower means and elevatable drawworks also require that pin connections and other structure necessary to connect the elevatable drawworks, drilling mast, and setback tower together to maintain them in elevated position be positioned and secured at substantial elevations above the earth's surface. Also, in some instances the presence of the A frame interfered with elevating the drawworks and presents clearance problems in positioning the drawworks in place in relation to the drilling mast and in between the A frame structure.

The present invention overcomes the above and other problems attendant with high floor elevated mast arrangements presently employed in that it provides the advantages of a high floor mast arrangement while enabling the mast to be positioned for elevation to an upright position from substantially adjacent the ground level thus eliminating many of the problems encountered with elevatable high floor mast arrangements heretofore employed.

An object of the present invention is to provide an arrangement including a low level base means for resting on the earth's surface, a drilling mast support means pivotally connected therewith and a drilling mast secured to the mast support means. A setback tower means is pivotally secured to the mast support means and is pivotally connected to the base means to be elevated with the mast support and mast from a reclined position to an upright position on the base means. The mast support means also includes lifting frame means for extending laterally and upwardly therefrom to enable the mast support means, mast and setback tower means to be simultaneously elevated without the use of an A frame or any other similar structure. Drawworks support means is pivotally connected to the base means and includes rotary table support beams projecting therefrom so that when the drawworks support means is elevated into position adjacent the upright mast, the drawworks is positioned in proper relation to the drilling mast and the rotary table support beams may be secured adjacent the upright setback tower means to secure the drawworks, mast support and setback tower together to form a substructure to support and enable drilling operations to be carried out at elevated position.

All of the foregoing can be accomplished and the necessity of making multiple connections and providing additional structure in an elevated relationship relative to the ground's surface is greatly reduced if not substantially eliminated.

For example, the only connections which cannot be made from ground level are the lifting frame means to the mast support means and rotary table support means to the elevated setback tower. The remainder of such pin connections and structure that may be required can be accomplished by a workman standing on the ground adjacent the upright mast, setback tower means, and drawworks means.

The lifting frame means, base means and mast support means, as well as the drawworks support means are provided with sheave means for enabling the mast support means, mast and setback tower means to be elevated to upright position and secured in such position by pinning the mast support to the base means, whereupon hook means associated with a traveling block which is supported from the crown block in the drilling mast may be employed to elevate the drawworks in position adjacent the elevated mast.

Other objects and advantages of the present invention will become apparent from a consideration of the following description and drawings.

DESCRIPTION OF THE PREFERRED EMBODIMENT

Figure 1:
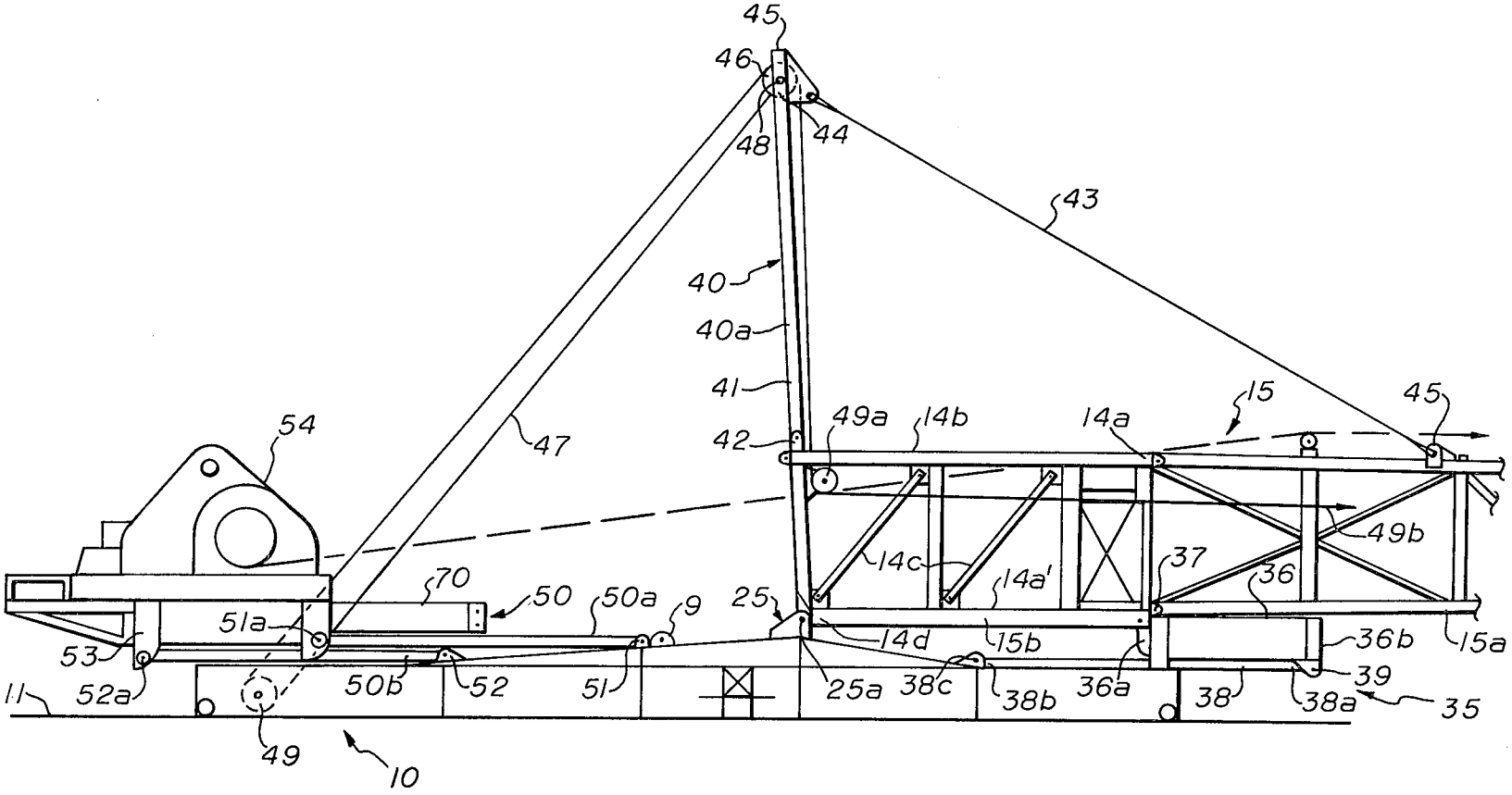
FIG. 1 is a side schematic view illustrating the base means on the ground, the drilling mast support means pivotally connected therewith, the lifting frame means extending laterally from the drilling mast support means, the drawworks support means pivotally connected to the base means and resting thereon with cable means connected at one end to the lifting frame means and extending around sheave means on the base means and over sheave means on the lifting frame means and under sheave means on the mast support means for connection at its other end with a power source to enable the mast support means, mast and the setback tower means to be simultaneously elevated to an upright position on the base means.

Attention is first directed to FIG. 1 of the drawings wherein base means represented generally by the numeral 10 is illustrated as resting on the earth's surface 11. A drilling mast support means as illustrated generally at 14 and is pivotally supported as generally illustrated at 25 on the base means 10. A drilling mast 15 is secured or pinned to the end 14*a* of the mast support 14. Setback tower means generally referred to at 35 is pivotally connected to the mast support means 14 and base means 10 as will be described in greater detail hereinafter.

Lifting frame means referred to generally by the numeral 40 are pivotally connected to the mast support means 14 for aiding in elevating the mast support means 14, mast 15 and setback tower 35 simultaneously from an inclined position to an upright position on the base means 10 as will be described hereinafter.

An elevatable drawworks support arrangement referred to generally at 50 is pivotally mounted on the base means 10 for enabling it to be elevated to an upright position adjacent the mast support means 14 and mast 15 after the mast support means and mast 15 thereon is elevated to an upright position.

Figure 5:
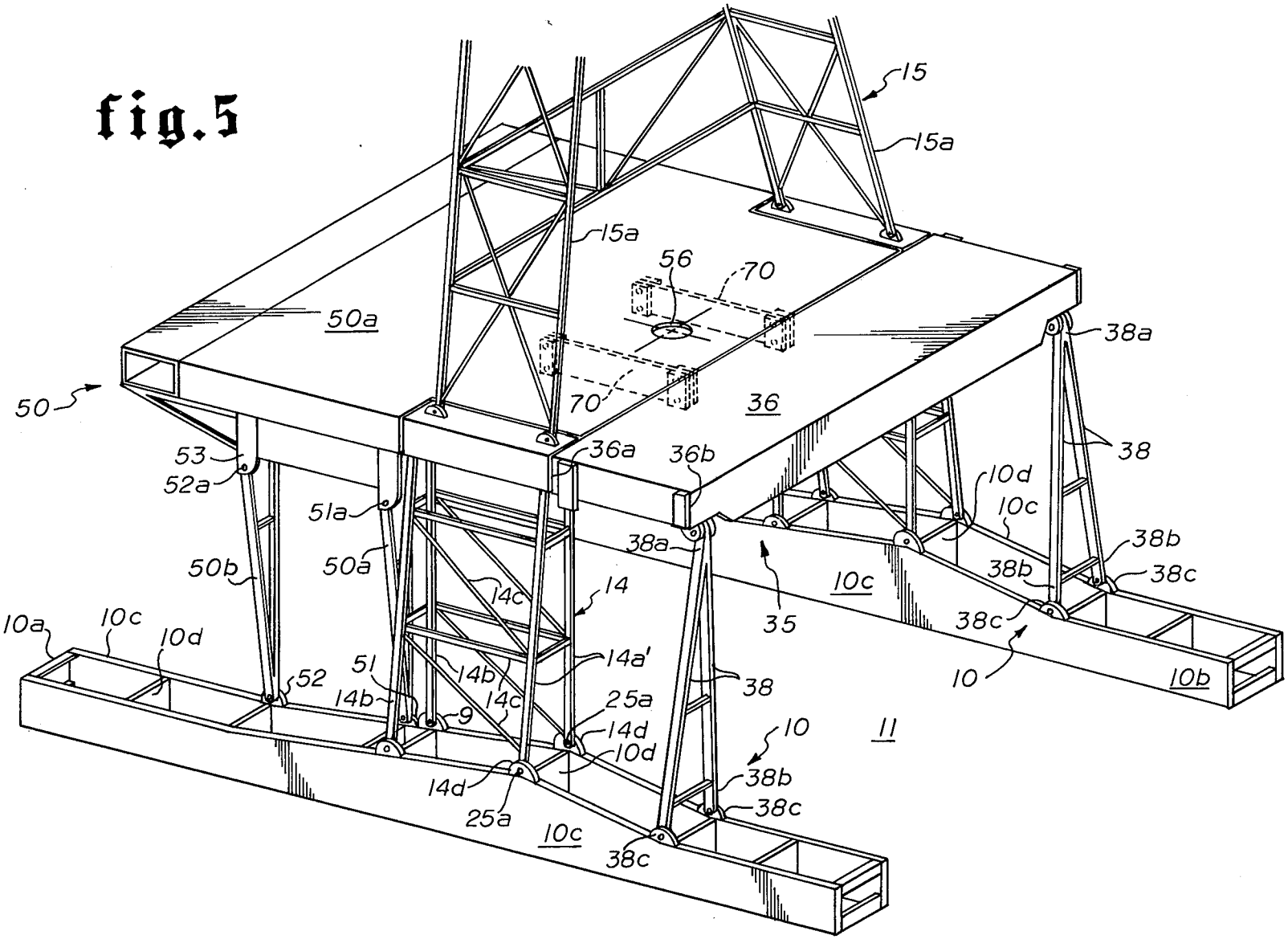
FIG. 5 is a perspective view showing the mast support means, mast, setback tower means and elevatable drawworks support in elevated position with the drawworks omitted.

In FIG. 5 the base means 10 is again illustrated in somewhat greater detail and is shown as including longitudinally extending box frame members 10*a* and 10*b* which may be formed in any suitable manner such as by the longitudinally extending beams 10*c* and laterally extending members 10*d* therebetween to provide a base of suitable length with the desired strength and rigidity.

The mast support means referred to at 14 is a box frame structure which may be formed in any suitable manner. As shown it includes longitudinally extending members 14*a* on one side and 14*b* on the other with the laterally extending brace members 14*c* therebetween. The members 14*a'* on one side of the mast support means 14 are pivotally connected at their ends 14*d* to the base means 10 by the lower end of the longitudinal legs or members 14*a'* being pinned by suitable means to the plate or footings 25*a* adjacent the upper edge of the base means 10. When the mast support structure 14 and mast 15 are reclined as shown in FIG. 1, the legs 14*b* are elevated as shown above the base support means 10. It can be appreciated that a footing 25*a* is provided on each of the laterally spaced longitudinally extending members 10*c* of the support means 10.

The setback tower means 35 includes a portion 36 which forms an upper floor surface when the tower 35 is elevated to an upright position on the base means 10. One end 36*a* of the upper floor surface forms what may be termed the other end of the setback tower structure that is pivotally connected as represented at 37, to the sides 14*a'* of the mast support means 14. Longitudinal beams or legs 38 are pivotally connected at one end 38*a* as illustrated at 39 to the other end 36*b* of the upper surface 36 and are connected at their lower ends 38*b* to the footing 38*c* on the base means 10 as shown.

The lifting frame means 40 includes at least a pair of beams or members 40*a*, one of which may be seen in the drawings. The lower end 41 of each of the members 40*a* is pivotally connected as illustrated at 42 adjacent the longitudinally extending members 14*b* of the mast support means 14 and when the lifting frame means 40 is in operative position, such lifting frame means will extend laterally and upwardly from the mast support means 14 as shown in FIG. 1 of the drawings. The beams 40*a* may be pinned in the position shown in FIG. 1 whereby a lifting force may be applied to the mast support means 14, mast 14 and setback tower means 35.

The elevatable drawwork support means 50 includes structure forming four longitudinal legs, two each on each of the longitudinally extending members 10*a* and 10*b* respectively, with two of such members being shown at 50*a* and 50*b*. It will be noted that they are pivotally connected at their respective lower ends to the base means 10 as illustrated at 51 and 52. Similarly, the other legs which are not visible are pivotally connected on the longitudinal extending member 10*b* forming part of the base means. The four members 50*a*, 50*b* are pivotally connected as illustrated at 51*a* and 52*a* at their upper ends to the support structure 53 for the drawworks represented at 54.

When it is desired to elevate the mast support 14, mast 15 and the setback tower 35 from a reclining position to an upright position on base means 10, the beam members 40*a* are secured to mast support means 14 to extend laterally as shown in FIG. 1. Sheave means 49 are provided on each longitudinally extending member 10*a* and 10*b* of base means 10 in spaced longitudinal relation to the pivot connection 25 of mast support means 14 on base means 10. Sheave means 46 are provided on the outer end 45 of each of the members 40*a* forming the lifting frame arrangement 40, sheave means 49*a* is mounted near the lower end of mast support means 14. Cable means 47 is connected adjacent the outer end 44 of each of the beams 40*a*. The cable means 47 is then extended around the sheave means 49 on the base means 10, over the sheaves 46 adjacent the outer end 44 of the members 40*a* and under the sheave means 49*a* on the mast support structure 14 so that the other end of the cable may be connected to a power source (not shown). When power is applied by the power source to pull the cable 47 in the direction of the arrow represented at 49*b*, the mast support 14, mast 15 and setback tower means 35 are simultaneously elevated as illustrated in FIG. 2 to an upright position as shown in FIG. 3.

After the mast support 14, mast 15 and setback tower 35 have been elevated to an upright position on the base means 10, the lower end of the sides 14*b* of the mast support 14 may be secured in position on each of the longitudinally extending members 10*a* and 10*b* of the base means 10 by securing such ends in the footings 9 in any suitable manner.

Thereafter, it is desirable to elevate the elevatable drawworks support means 50 in position adjacent the side 14*b* of the upright mast support means 14. It will be noted that as shown in FIG. 3 rotary table support beams 70 project forwardly from the support structure 53 for the drawworks 54. When the drawworks support is elevated to an upright position, the rotary table beams 70 with the rotary table supported thereon extend between the legs of the mast 15 and adjacent the upper end of mast support 14 to be positioned as illustrated at 56 in FIG. 5. Also, the rotary table support beams 70 terminate adjacent the edge 36*a* of the setback tower 35 and as shown in dotted line in FIG. 5 may be pinned thereto by any means well known in the art.

Figure 2:
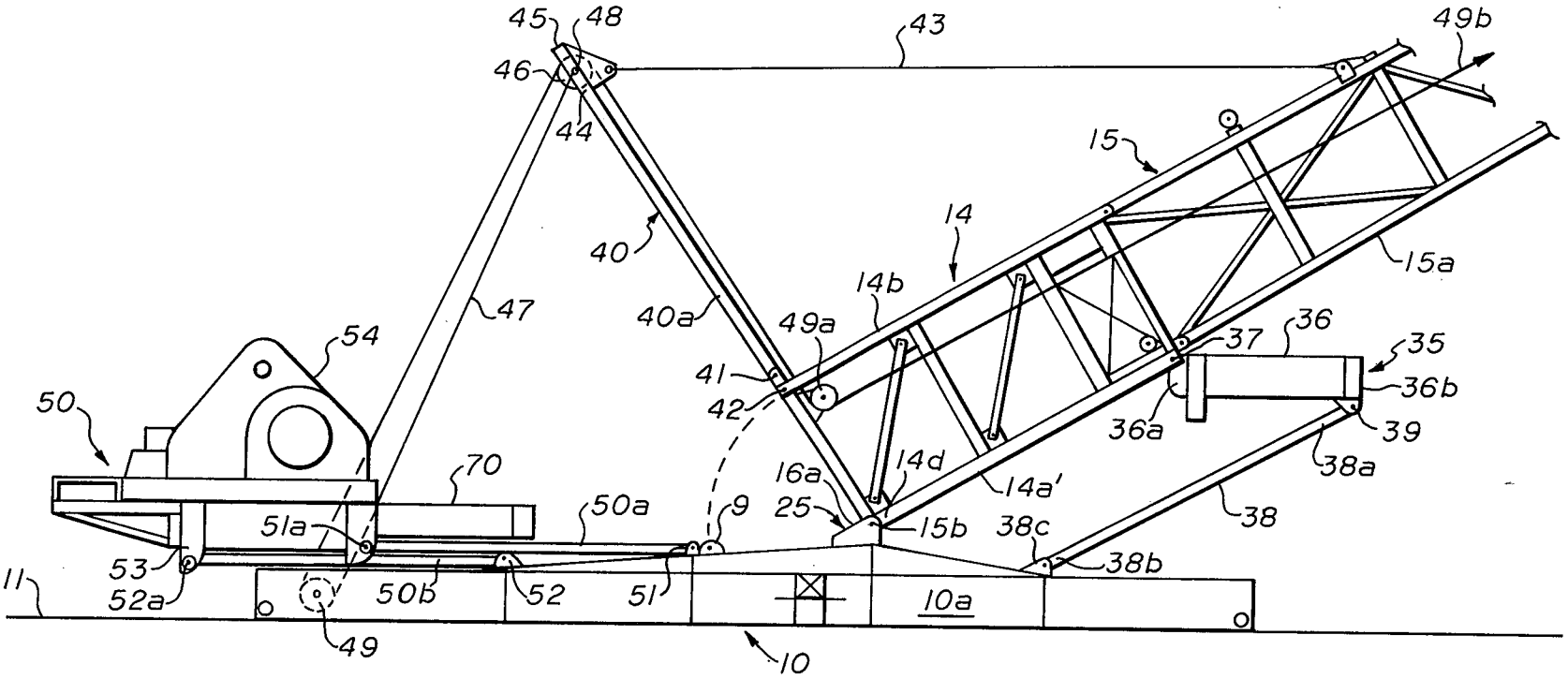
FIG. 2 is a schematic view similar to FIG. 1 and showing the drilling mast support means and setback tower means which is pivotally connected therewith and to the base means being elevated to an upright position.
Figure 3:
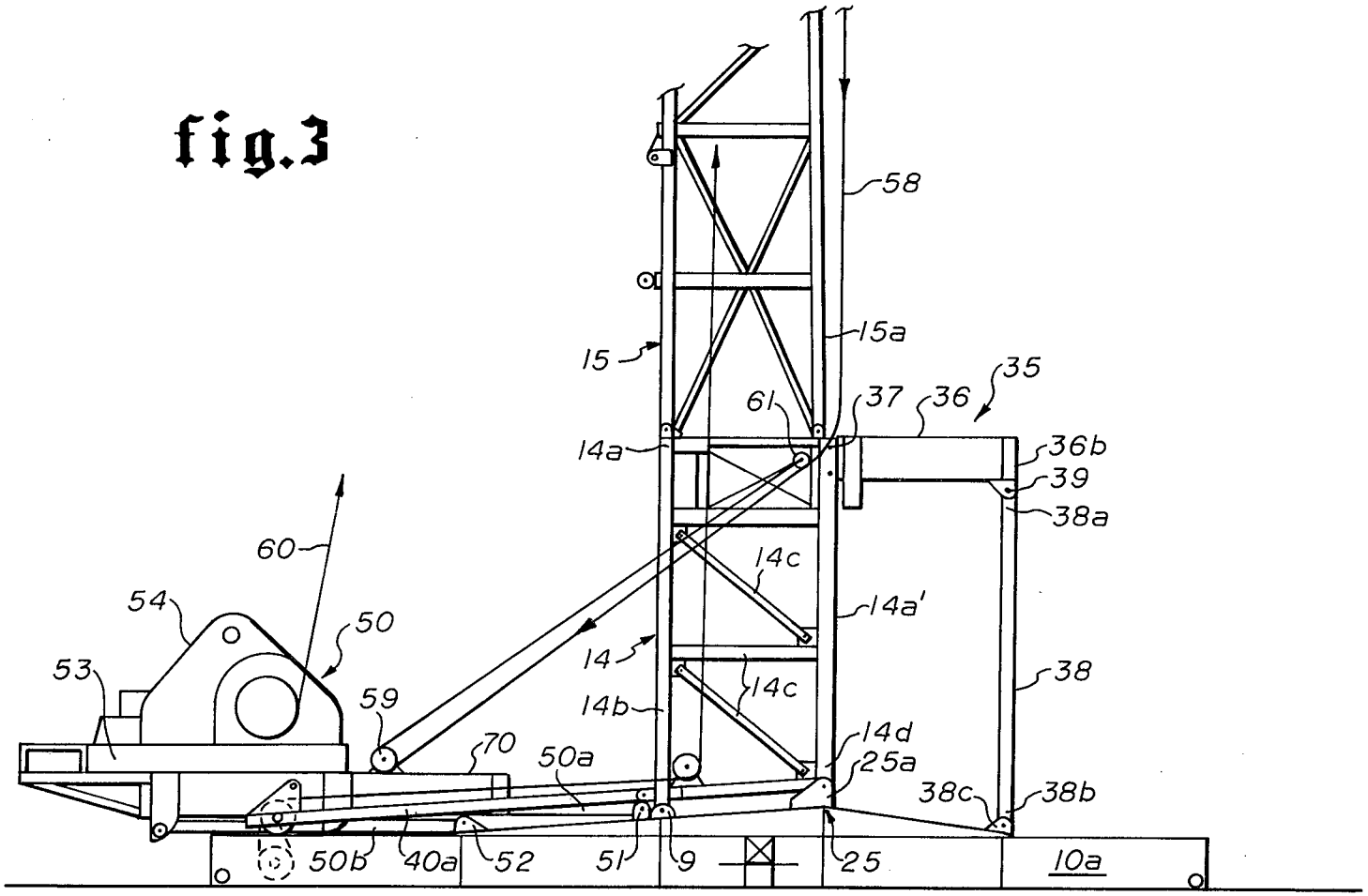
FIG. 3 is a schematic view showing the mast support means, mast and setback tower means in upright position on the base means with cable means rigged up to elevate the pivotally connected drawworks means from its lowered position on the base means to an upright position on the base means and adjacent the upright mast support means.
Figure 4:
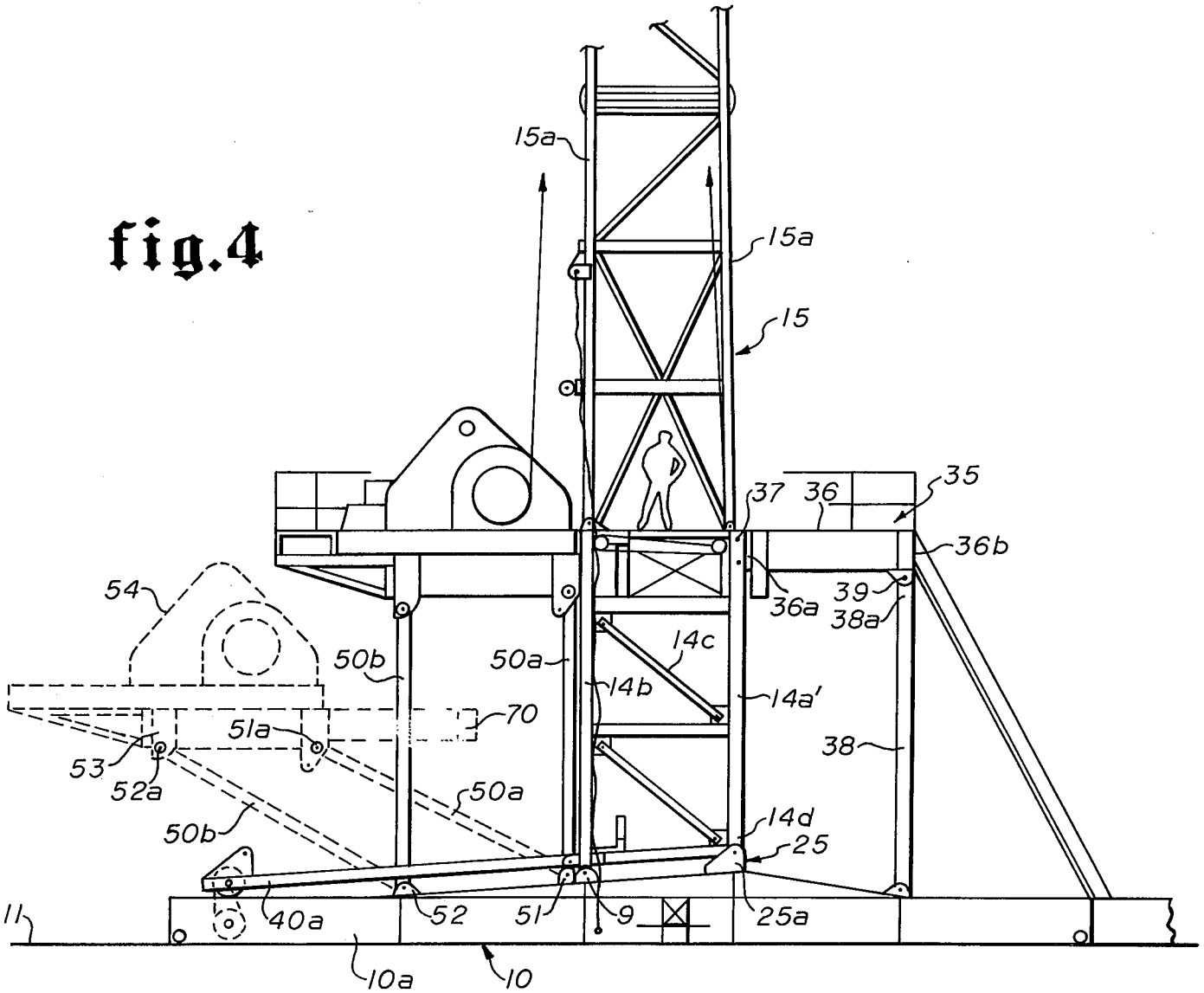
FIG. 4 illustrates in dotted line the elevatable drawworks as it moves to an upright position and in solid line the final position of the elevatable drawworks.

The elevatable drawworks arrangement 50 is elevated from its reclined position shown in FIGS. 1–3 on the base means 10 upwardly to an upright position moving in an arc as illustrated in FIG. 4 in dotted line, with the upright position being shown in full line. The drawworks support means illustrated generally at 50 is elevated by means well known in the art. For example, the cable 60 extending from the drum on the drawworks apparatus 54 is connected with the crown block (not shown) on top of the mast 15. The crown block supports a movable block (not shown) comprising a plurality of sheaves and a hook depending therefrom with which the cable 58 is connected. The cable 58 then extends downwardly and around the sheave 59 on the drawworks arrangement 50 and is then tied at its end 61 to the upright mast support 14. When the cable 60 is reeved in on the drawworks 54, this causes the movable hook in the mast 15 to move upwardly thereby causing the cable 58 to move upwardly and elevate the elevatable drawworks arrangement 50. When it assumes the position as shown in FIG. 4 adjacent the side **14*b* of the mast support 14, it can be pinned in position by the rotary table support beams 70** being connected to the elevated setback tower as previously described.

It is to be noted that the elevatable drawworks arrangement 50 includes a floor **50*a* thereon which extends between the legs of the upright mast 15 and terminates immediately adjacent the top surface 36 of the elevated setback tower 50**.

The foregoing arrangement provides a high floor mast arrangement which floor is formed by the floor **50*a* on the elevated drawworks arrangement 50 and the top 36 of the setback tower 35**.

From the foregoing description it can be appreciated that after the base means comprising the longitudinal members **10*a* and 10*b* have been positioned on the earth's surface, the mast support 14 and mast 15 may be moved in at truck height and pivotally secured as illustrated at 25 to each of the members 10*a* and 10*b*. This eliminates the use of a crane and enables the mast support 14 and mast 15 connected thereto to be pivotally secured in position substantially at ground level on base means 10 so that all work in mounting the mast support and mast on the base means may be accomplished at ground level. The lifting frame means 40 enables the mast support 14, mast 15 and the setback tower 35** to be simulatenously raised and to be simultaneously raised without employing an A frame or other structure, such as a crane or the like, on top of a previously constructed and positioned elevated support structure.

Since no A frame is required to lift the mast, there is no interference in lifting or elevating the elevatable drawworks arrangement 50 to its final upright position to provide an elevated working floor surface area to accommodate drilling operations in a desired elevated, spaced relationship relative to the ground 11 therebeneath.

When the mast support 14 and mast 15 are reclining the sides **14*a* of the mast support and the sides 15*a* of the mast are supported by the portion 36 of the setback tower 35 which is reclined on the base means 10** as shown in the drawings.

The forgoing arrangement provides an arrangement wherein the substructure for a high floor, low lift mast is made up of the substructure bottom boxes **10*a* and 10*b* which form the foundation of the entire drill rig, the mast supporting structure 14, the setback structure 35 and the drawworks supporting structure 50. The entire structure is readily and easily assembled at or near ground level with the bottom boxes 10 and 10*b* set first and the balance of the structures pinned to the bottom boxes. The mast 15 is pinned to the mast support structure 14 and the drawworks, rotary, flooring and doghouse are installed on the drawworks support structure 53. The drawworks power is used to raise the mast, the mast supporting structure and the setback supporting structure to vertical or upright position. The drawworks power is used to elevate the drawworks, rotary, flooring and doghouse by elevating the drawworks supporting structure to upright position by the parallelogramming method. The pins to connect the rotary beams 70 to the setback structure 35** are installed, if necessary drop in a couple of pieces of flooring, set the stair, ramp and the structure is ready for drilling operations.

The foregoing disclosure and description of the invention are illustrative and explanatory thereof, and various changes in the size, shape and materials as well as in the details of the illustrated construction may be made without departing from the spirit of the invention.

What is claimed is:

1. A low lift, high floor drilling mast and substructure arrangement therefor comprising:

a. base means for resting on the earth's surface;

b. drilling mast support means pivotally connected to said base means;

c. setback tower means pivotally connected to said drilling mast support means and to said base means;

d. elevatable drawworks support means pivotally mounted on said base means;

e. drilling mast means secured to said mast support means; and f. lifting frame means connected to said drilling mast support means whereby said drilling mast means, support means therefor and setback tower means may be simultaneously elevated from a reclined position to an upright position on said base means.

2. The invention of claim 1 including means to secure said drilling mast support means to said base means when in upright position thereon.

3. The invention of claim 1 including rotary table support beam means projecting from said drawworks support means for extending through said drilling mast support means when said drawworks support means is elevated to an upright position on said base means.

4. The invention of claim 3 including means to secure said rotary table support beams adjacent said upright setback tower means.

5. The invention of claim 1 wherein said drilling mast support means is a box frame structure having at least four sides and which when in reclined position has one of said sides supported by said reclined setback tower means on said base means and another of said sides laterally spaced and elevated in relation to said base means.

6. The invention of claim 5 including:

a. means to secure said elevated side to said base means when said mast support means is in upright position thereon; and b. means to secure said rotary table support beam means to said upright setback tower means to provide a unitary substructure for said drilling mast supported thereon.

7. The invention of claim 1 wherein:

a. said drilling mast support means is a box frame structure having at least four sides and which when in reclined position has one of said sides supported by said reclined setback tower means on said base means and another of said sides laterally spaced and elevated in relation to said base means; and b. said lifting frame means is connected to said laterally spaced, elevated side of said box frame structure.

8. The invention of claim 7 wherein said lifting frame means comprises at least a pair of laterally spaced beams connected to said laterally spaced, elevated side of said box frame structure and extending laterally and upwardly therefrom.

9. The invention of claim 8 wherein:

a. said beams are each provided adjacent their upwardly extending ends with sheave means;

b. sheave means mounted on said base means in longitudinal spaced relation to said pivotally connected drilling mast support means;

c. sheave means mounted on said drilling mast support means; and d. cable means for securing adjacent the upwardly extending end of said beams and then extended around said sheave means on said base means, beams and mast support means for connection with a power source to simultaneously elevate said drilling mast support means, drilling mast means and setback tower means.

10. The invention of claim 7 wherein;

a. said lifting frame means is pivotally connected to said elevated side of said box frame structure; and b. means for securing said lifting frame means in non pivotal relationship to said box frame structure to retain said lifting means in laterally and upwardly extendng relation to said box frame structure.

11. The invention of claim 1 including:

a. floor means on said drawworks support means which extends through said mast means when said drawworks support means is elevated to an upright position; and b. floor means on said setback tower means adjacent said floor means on said elevated drawworks support means.

12. A low lift, high floor drilling mast and substructure arrangement therefor comprising:

a. base means for resting on the earth's surface;

b. drilling mast support means pivotally connected to said base means;

c. drilling mast means secured to said mast support means;

d. setback tower means pivotally connected to said drilling mast support means and to said base means;

e. said setback tower means extending longitudinally of and between said mast support and mast means secured thereto and supporting said mast support and mast means on said base means when said mast, mast support means and setback tower means are in reclining position thereon.

13. The invention of claim 12 including frame means connected to said drilling mast support means whereby said drilling mast means, support means therefor and setback tower means may be simultaneously elevated from a reclined position to an upright position on said base means.

* * * * *